United States Patent [19]

Shiley

[11] Patent Number: 5,066,237

[45] Date of Patent: Nov. 19, 1991

[54] CONNECTOR PRESS FIT EYELET

[75] Inventor: Robert J. Shiley, Riverside, Calif.

[73] Assignee: ITT Corporation, New York, N.Y.

[21] Appl. No.: 600,654

[22] Filed: Oct. 22, 1990

[51] Int. Cl.[5] ..... H01R 9/09

[52] U.S. Cl. ..... 439/82; 411/508; 439/567

[58] Field of Search ..... 439/92, 101, 108, 79, 439/80, 82, 83, 84, 607, 554, 567, 571, 572, 573, 751; 411/508

[56] References Cited

U.S. PATENT DOCUMENTS

| | | | |
|---|---|---|---|
| Re. 32,502 | 9/1987 | Kumar | 439/92 |
| 2,523,239 | 9/1950 | Tinnerman | 85/5 |
| 3,139,768 | 12/1961 | Biesecker | 74/501 |
| 3,486,158 | 12/1969 | Soltysik | 339/14 |
| 3,506,942 | 4/1970 | Alimena | 339/17 |
| 3,562,847 | 2/1971 | Jemison | 16/2 |
| 3,686,609 | 8/1972 | Hansen | 339/14 |
| 4,050,772 | 9/1977 | Birnholz et al. | 339/220 |
| 4,175,810 | 11/1979 | Holt et al. | 339/17 |
| 4,205,889 | 6/1980 | Rieman | 339/17 |
| 4,518,209 | 5/1985 | Negley | 339/14 |
| 4,521,062 | 6/1985 | Kurbikoff et al. | 339/14 |
| 4,679,883 | 6/1987 | Assini et al. | 439/607 |
| 4,709,973 | 12/1987 | Waters et al. | 439/78 |
| 4,717,219 | 1/1988 | Frantz et al. | 439/82 |
| 4,721,473 | 1/1988 | DelGuidice et al. | 439/79 |
| 4,735,587 | 4/1988 | Kirayoglu | 439/751 |
| 4,842,529 | 6/1989 | Frantz et al. | 439/95 |
| 4,842,552 | 6/1989 | Frantz | 439/557 |
| 4,865,555 | 9/1989 | Assini et al. | 439/82 |
| 4,874,336 | 10/1989 | Marsh | 439/607 |

FOREIGN PATENT DOCUMENTS 0180284 5/1986 European Pat. Off. .

*Primary Examiner*—Neil Abrams

*Attorney, Agent, or Firm*—Thomas L. Peterson

[57] ABSTRACT

Eyelets are described that project through holes in the legs of a connector and through plated holes of a circuit board, to hold the connector to the board until they can be soldered together. When the eyelet is fully installed, a cap 56 (FIG. 3) at its top rests against a leg 30 of a plastic connector body, while a tubular portion of the eyelet projects through the leg 40 of a metal connector shell and into the plated hole 20 of the circuit board. The tubular portion of the eyelet has upwardly extending tines 66 that each has a contact part 78 (FIG. 8) lying a distance below the cap equal to the combined thickness T (FIG. 3) of the connector body and shell legs, so the contact part lies adjacent to the shell leg 40 to solder to it. The diameter of the shell hole 46 is smaller than the diameter of the circuit board hole.

13 Claims, 3 Drawing Sheets

FIG. 4
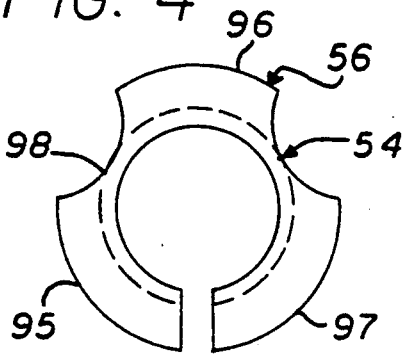
FIG. 5
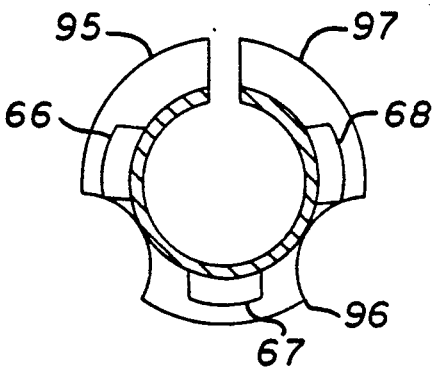
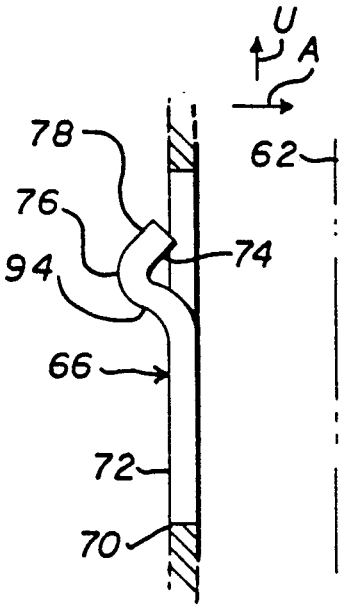
FIG. 6
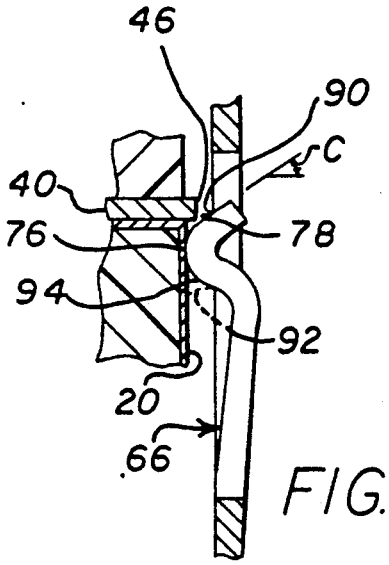
FIG. 8
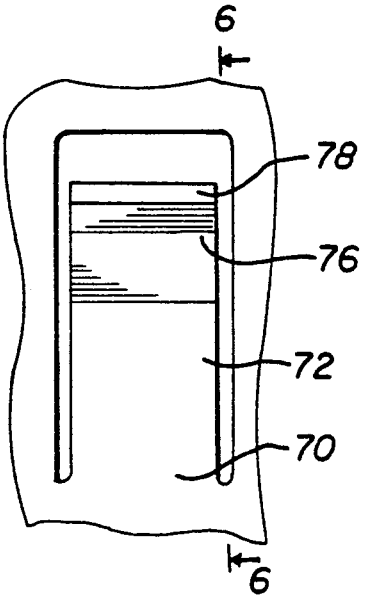
FIG. 7

FIG. 9
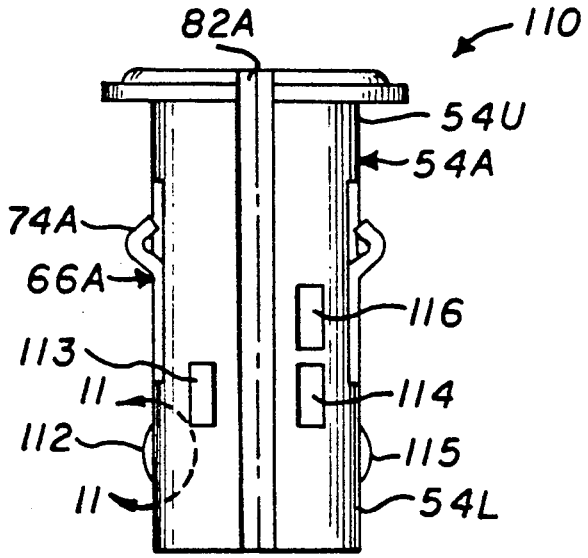
FIG. 10
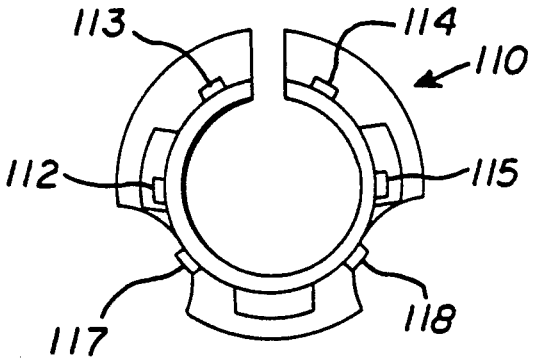
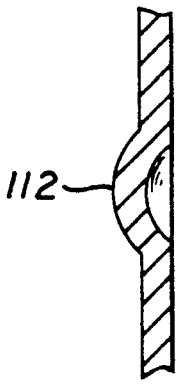
FIG. 11

CONNECTOR PRESS FIT EYELET

BACKGROUND OF THE INVENTION

Electrical connectors such as the miniature D type, can be mounted on a circuit board and grounded to it by fasteners projecting through holes in the legs of the connector and into holes in the circuit board. The connector includes a plastic molded body with body legs, and a sheet metal shell with shell legs, the body and shell legs having aligned holes for receiving the fastener. An eyelet or other fastener can project through the holes in the legs and the circuit board to keep them aligned and to hold them together. U.S. Pat. No. Re. 32,502 shows a connector of this type, wherein a simple tubular eyelet holds the assembly together either by soldering the eyelet in place or by crimping or upsetting the bottom of the eyelet. While the eyelet can hold the parts together after a final operation wherein the eyelet is soldered to the parts or its bottom is crimped in place, there is danger that the eyelets will fall out during handling of the assembly, such as when the assembly is turned upside down prior to wave soldering. An eyelet fastener which could not only hold the assembly together after all operations were concluded such as soldering or crimping, but which could also hold the assembly together with at least a moderate force prior to soldering or crimping when the assembly might be turned upside down, would be of considerable value.

SUMMARY OF THE INVENTION

A fastener is described which can pass through holes in the plastic and metal legs of a connector and into a hole in a circuit board to hold the parts together both temporarily and after a final assembly operation, which is easily constructed and installed. The fastener comprises a metal eyelet that is preferably formed of sheet metal bent into a tube with a vertial axis and with a cap on top. The tube has slits forming a plurality of fingers or tines that each have an upper part extending with a horizontal directional component to lie adjacent to the shell of the connector leg to keep the assembly together until it can be soldered in place or the bottom of the eyelet bent over. The contacting part preferably extends with an upward and radially inward directional component to lie adjacent to the shell despite small variations in dimensions, and the hole in the shell is smaller than the hole in the circuit board. The eyelet can also have bumps in its lower portion for engaging the walls of the circuit board hole.

The novel features of the invention are set forth with particularity in the appended claims. The invention will be best understood from the following description when read in conjunction with the accompanying drawings.

BRIEF DESCRIPTION OF THE DRAWINGS

FIG. 4 is a plan view of the eyelet of FIG. 2.

FIG. 5 is a view taken on the line 5—5 of FIG. 2.

FIG. 6 is a partial sectional view of the area 6—6 of FIG. 2, and as taken on line 6—6 of FIG. 6.

FIG. 7 is a view taken on the line 7—7 of FIG. 2.

FIG. 8 is an enlarged sectional view of a portion of the assembly of FIG. 3.

FIG. 9 is a side elevation view of an eyelet constructed in accordance with another embodiment of the invention.

FIG. 10 is a bottom view of the the eyelet of FIG. 9.

FIG. 11 is a partial section view of the area 11—11 of FIG. 9.

DESCRIPTION OF THE PREFERRED EMBODIMENTS

Figure 1:
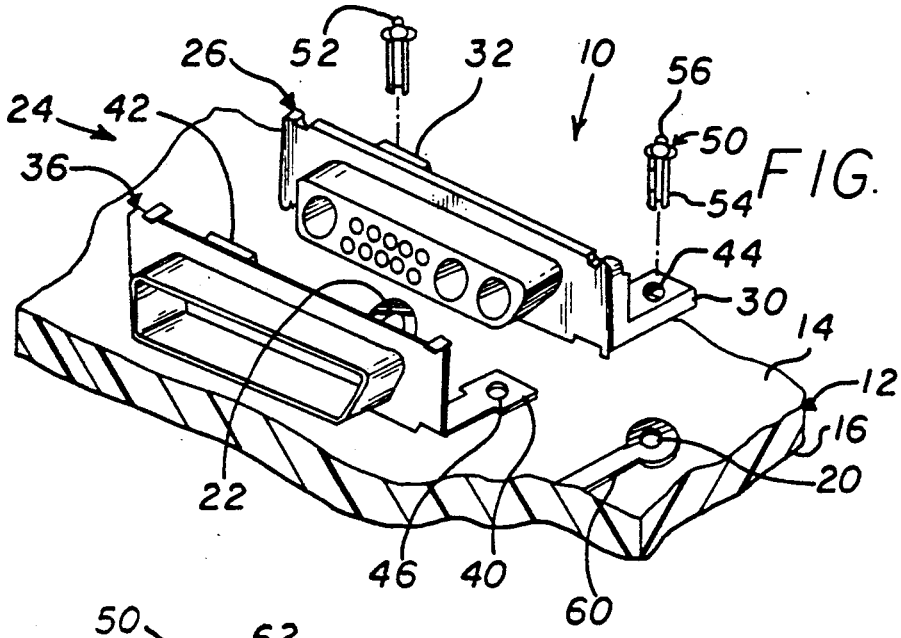
FIG. 1 is an exploded perspective view of a connector, a circuit board, and eyelet fasteners of the present invention.

FIG. 1 illustrates a connector and circuit board assembly 10 which includes a circuit board 12 having upper and lower faces 14, 16 and a pair of plated-through holes 20, 22. A connector 24 to be mounted on the upper face of the circuit board, includes a plastic body 26 with a pair of body mounting legs 30, 32. The connector also includes a conductive metal shell 36 that has shell legs 40, 42. The body and shell legs have holes 44, 46 that are aligned with each other and with the circuit board holes, to receive eyelet fasteners, or eyelets 50, 52. Terms such as "upper" and "lower" which describe the orientation of a part with respect to Earth gravity are used herein only to simplify the description, and it should be understood that the parts can be used in any orientation with respect to gravity.

Each eyelet has a tubular portion 54 which is inserted through the aligned holes of the connector and circuit board, until a cap 56 at the top of the tubular portion rests against the top of the body leg such as 30. After the eyelets are installed, a final operation is performed, such as soldering, to securely hold the parts together. The final operation also provides a secure electrical connection between a circuit board grounded conductive trace 60 that is integral with a plating on the circuit board hole 20, and the shell leg 40, with the eyelet such as 50 being soldered to both the shell and the walls of the circuit board hole. During the final operation such as soldering, the assembly may be turned upside down or otherwise handled in a manner that could cause the eyelets to fall out unless they are held in place with at least a moderate force. The eyelets such as 50 are constructed to hold the parts of the assembly together with a moderate force prior to a final finishing operation such as soldering, and also to provide eyelet regions adjacent to the shell and circuit board hole plating to reliablly connect them together.

Figure 2:
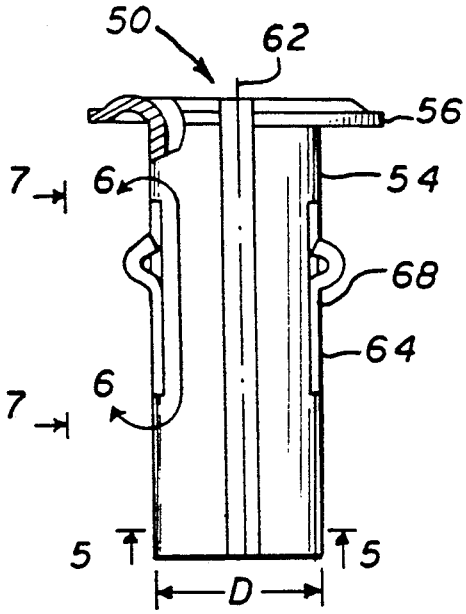
FIG. 2 is a side elevation view of one of the eyelets of FIG. 1, prior to installation.

FIG. 2 illustrates details of the eyelet 50. The eyelet is formed from sheet metal that has been cut or blanked and then rolled to form the tubular portion 54, the cap 56 then being bent perpendicular to the eyelet axis 62. The tubular portion has slits 64 forming fingers or tines 66 -68. As shown in FIGS. 6 and 7, each tine such as 66 has a lower end 70 merging with the rest of the tube, a primarily vertical elongated middle portion 72 extending upwardly from the lower end, and an upper portion 74 forming a free end. The upper portion has a radially outer part 76 that can press against the walls of the circuit board hole, and a shell contacting part 78 that can lie adjacent to the shell to make a good solder connection therewith. The shell contacting part 78 extends at an upward and radially-inward direction, that is both upwardly along the direction U, and radially inwardly along the direction A towards the eyelet axis 62.

Figure 3:
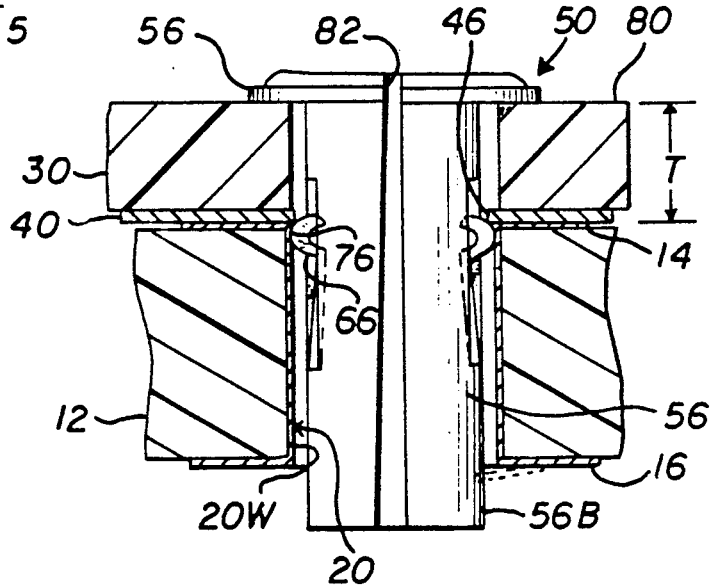
FIG. 3 is a side elevation view of the eyelet of FIG. 2, shown installed in the assembly of FIG. 1.

FIG. 3 shows the eyelet in a fully installed position, wherein it holds the body leg 30, shell leg 40, and circuit board 12 together, but prior to soldering the eyelet in place. The cap 56 lies against the upper surface 80 of the body leg, which prevents any further downward movement of the eyelet. The radially outer parts 76 of the tines such as 66 bear against the plated walls 20*w* of the circuit board hole 20, to provide friction that resists upward movement of the eyelet. The distance of the contact part 78 below the cap 56 is equal to the combined thickness T of the body and shell. It may be noted that the eyelet slot 82 that results from the eyelet being formed of a rolled piece of sheet metal, can vary in width after installation, and may be wider along the bottom 56*b* of the tubular portion. While the tines such as 66 provide resiliency to engage the walls of the circuit board hole, the resiliency of the eyelet itself tends to cause its resilient expansion to also provide for biasing against the walls of the holes. In an eyelet design of the construction shown, the tubular proportion of the eyelet has a fully expanded diameter D of 0.114 inch, and withstands an upward pullout force of at least two pounds.

As shown in FIG. 8, the shell contact part 78 lies very close to the walls of the hole 46 in the shell 40. This assures that when the parts are soldered together, the shell and tine 66 are very close together to provide for a good solder connection whose limits are indicated at 90 and 92. The diameter of the shell hole 46 is preferably smaller than the diameter of the circuit board hole 20, to assure closeness of the bottom of the walls of the shell hole 46 to the contact part 78 of the tine. The contact part 78, which extends both upward and radially inwardly, preferably extends at angle C with a horizontal of about 45°, that is, between about 20° and 70° so as to lie adjacent to the shell hole walls. The upper portion 74 of the tine includes a deflect part 94 lying below the contact part 78. The deflect part 94 extends radially outwardly and upwardly, to ride over the walls of the holes such as 46 during insertion of the eyelet. The outer part 76 lies at the intersection of the contact and deflect parts 78, 94.

As shown in FIGS. 4 and 5, the cap includes a plurality of cap tabs 95–97, with curved or circular cutouts 98. The curved cutout 98, which extends between the opposite sides of adjacent tabs, increases the width of the radially inner edges of the tabs, as compared to tabs whose opposite sides were parallel, to provide greater resistance to upward bending of the tabs.

FIGS. 9–11 illustrate an eyelet 110 of another design, which includes a plurality of radially outwardly projecting protrusions in the form of bumps 112–118. The bumps such as 112 can firmly engage a lower portion of the circuit board hole, while the tines such as 66A engage the upper portion of the hole to resist upward pullout of the eyelet. The bumps also provide a region adjacent to the plated walls of the circuit board hole that can be securely soldered to the circuit board hole. Both the upper and lower parts 54U, 54L of the eyelet tubular portion 54A are compressed or reduced in diameter when passing through the hole in the circuit board, and each end can expand individually by expansion of the slot 82A in the eyelet. This allows both the upper portion 74A of the tines and the bumps such as 112 to firmly contact the walls of the circuit board hole to hold the eyelet in place.

Thus, the invention provides a fastener for passing through holes in the plastic and metal legs of a connector and the hole in a circuit board, to hold them together and provide good electrical connection between the shell and plated walls of the board hole. The eyelet has a tubular portion with slits forming a plurality of tines having upper portions that bear against the walls of the circuit board hole. The upper portion of each tine also has a contact part extending with upward and radially inward directional components, to lie adjacent to the shell. The diameter of the shell hole is preferably smaller than the diameter of the circuit board hole to assure that the shell and contact part of the tines lie closely adjacent. The eyelet is preferably formed of a metal sheet rolled into a tubular shape with a cap at the top. The lower portion of the eyelet can be formed with bumps to securely press against the walls of the circuit board hole so that both the upper and lower portions of the eyelet are pressed against the circuit board hole to hold the eyelet in position.

Although particular embodiments of the invention have been described and illustrated herein, it is recognized that modifications and variations may readily occur to those skilled in the art, and consequently it is intended that the claims be interpreted to cover such modifications and equivalents.

I claim:

1. A fastener for holding the leg of a plastic connector body and the leg of a metal shell lying thereunder, of predetermined combined thickness, to a circuit board having a hole and a grounded conductive trace extending to the hole, and for electronically connecting the shell to the circuit board trace, wherein the legs and circuit board have aligned holes, comprising:

a metal eyelet with a tubular portion having an axis, a top, and a cap at the top, said tubular portion having a plurality of slits therein forming a plurality of tines that project radially outwardly from adjacent areas of the tubular portion, whereby to retain said eyelet in said circuit board hole;

each of said tines having a contact part lying a distance below said cap equal to said combined thickness of said plastic body leg and said metal shell leg to lie adjacent to the bottom of said shell, and each contact part extends with a horizontal directional component to lie adjacent to the bottom of said shell hole.

2. The fastener described in claim 1 wherein:

each of said tines has a lower end merging with the rest of said tubular portion, a middle extending primarily upwardly, and an upper portion forming said contact part, said contact part extending with a horizontally radially-inward directional component.

3. The fastener described in claim 2 wherein:

each said tine upper portion includes a deflect part lying below said contact part, said deflect part extending radially outwardly and upwardly.

4. The fastener described in claim 1 wherein:

said tubular portion has a plurality of radially outwardly projecting bumps that lie below said tines and that project radially outwardly to form an interference fit with the walls of the circuit board hole at locations below said tines.

5. The fastener described in claim 1 including:

a connector forming a pair of body legs and shell legs that include said body leg and shell leg, said shell legs lying against said circuit board and said body legs lying against said shell legs;

a pair of identical eyelets including said eyelet, each eyelet projecting through holes in one of said body legs, shell legs, and circuit board;

each shell hole has walls forming the hole therein, each shell hole is of smaller diameter than each corresponding circuit board hole, and said contact part of each tine substantially abuts the bottom of the walls of the shell hole.

6. A connector-circuit board assembly comprising:

a circuit board having upper and lower faces and walls forming a pair of holes of predetermined diameter, each hole being metal plated;

a connector for mounting on said upper board face, said connector including a plastic body with a pair of body legs lying over said board upper face and a metal shell with a pair of shell legs lying between said body legs and said upper board face, each body leg and corresponding shell leg having walls forming aligned holes that are aligned with one of said board holes;

a pair of eyelets that are each formed from a portion of a metal sheet that has been cut and then rolled, each eyelet having a cap lying on top of one of said body legs and having a tubular portion lying about an eyelet axis and projecting through the leg hole, a shell hole, and a board hole;

the tubular portion of each eyelet having a plurality of slits forming a plurality of tines that each has a free end with a contact part that lies further from said axis than adjacent area of said tubular portion, each contact part extending in an upward and radially inward direction and lying adjacent to the walls of one of said shell holes.

7. The assembly described in claim 6 wherein:

the diameters of shell holes are each smaller than the diameters of said circuit board holes.

8. The assembly described in claim 6 wherein:

the tubular portion of each eyelet includes a plurality of radially outwardly deformed regions forming bumps lying closer to the lower face of said circuit board than the upper face thereof, said bumps pressing against the walls of said circuit board hole.

9. A fastener for passing through holes in the plastic and metal legs of a connector and the hole in a circuit board, to hold them together, comprising:

a metal eyelet comprising a metal sheet bent into a tube with a vertical axis and a top, and with a cap on the top, said tube having a plurality of slits forming at least one radially outwardly projecting tine having a lower end merging with said tube, a primarily vertical elongated middle portion, and an upper portion with a contacting part extending with an upward and radially inward directional component.

10. The fastener described in claim 9 wherein:

said upper portion includes a deflect part lying below said contact part and extending with an upward and radially outward directional component.

11. The fastener described in claim 9 wherein:

said eyelet has a plurality of radially outwardly deformed regions forming bumps that lie below said upper portions of said tine and closer to bottom of said eyelet than to said top thereof.

12. The fastener described in claim 9 wherein:

said cap has a plurality of concave curved cutouts extending to the diameter of said tubular portion.

13. The fastener described in claim 9 including:

a circuit board having a plated hole;

a metal shell leg lying on said board and having walls forming a hole aligned with said board hole;

a plastic body leg lying over said shell leg and having a hole aligned with said board and shell holes;

said shell hole being of smaller diameter than said board hole, and said eyelet projects through said holes, with said cap lying on said body leg and said contacting part of said eyelet lying substantially against the bottom of the walls of said shell hole.

* * * * *